United States Patent [19]

Yamaguchi

[11] Patent Number: 4,969,223

[45] Date of Patent: Nov. 13, 1990

[54] PAD COVER

[75] Inventor: Tomoyoshi Yamaguchi, Tokyo, Japan

[73] Assignee: Japan Life Co., Ltd., Tokyo, Japan

[21] Appl. No.: 330,564

[22] Filed: Mar. 29, 1989

[30] Foreign Application Priority Data

Jan. 25, 1989 [JP] Japan ..... 1-7108

[51] Int. Cl.[5] ..... A47C 27/14

[52] U.S. Cl. ..... 5/470; 5/465; 5/480

[58] Field of Search ..... 5/465, 470, 480, 499

[56] References Cited

U.S. PATENT DOCUMENTS 853,049 5/1907 Weston ..... 5/480
4,365,371 12/1982 Boussaroque ..... 5/470 X
4,597,120 7/1986 Fogel et al. ..... 5/455 X
4,706,313 11/1987 Murphy ..... 5/470 X

FOREIGN PATENT DOCUMENTS 555821 5/1957 Belgium ..... 5/470

*Primary Examiner*—Michael F. Trettel
*Attorney, Agent, or Firm*—Browdy and Neimark

[57] ABSTRACT

A pad cover of a size capable of containing two pads in parallel, wherein a partitioning wall is provided in said cover to traverse the center thereof, short side walls of cover are formed to which the ends of said partitioning wall are fastened, and openings are formed starting from both sides of said short side walls running through the ends of the two sides.

Owing to the presence of the partitioning walls, the two pads can be easily pulled out or inserted through the openings.

3 Claims, 1 Drawing Sheet

PAD COVER

BACKGROUND OF THE INVENTION

The present invention relates to a pad cover, and more specifically to a pad cover which contains two pads (mattresses) as described in, for example, U.S. Pat. No. 4,509,219, that are heavy, generally hard, and can be folded or bent with difficulty, in order to form a pad of a so-called king size (double size).

DESCRIPTION OF THE PRIOR ART

The pad of the above-mentioned type has the objective of maintaining a properly lying position of a person by preventing the sinking at the waist portion and the back portion, and has a hard core member embedded therein. Therefore, the pad is heavy, bends little, and is not convenient for being carried. When the pad is produced in a large size, i.e., in a so-called king size to be used by a big person, the user will find it heavier and more cumbersome to handle. Therefore, the pad is not produced in a large size but, instead, two pads of a single size are usually used after being arranged in parallel.

When the two pads are used in a manner as described above, however, they often move away from each other while the user is asleep and the body sinks between the two pads. It can therefore be contrived to contain the two pads in a single large cover involving, however, a very cumbersome operation. That is, the first pad that is introduced through the opening must be pushed deep into the innermost part of the cover. However, the pad is so heavy that it is not easy to place it in position in the innermost part of the cover Furthermore, the second pad that is inserted often enters deep into the inner portion, whereby the first pad becomes an obstacle, and is not easily placed in position on the side near to you.

SUMMARY OF THE INVENTION

The object of the present invention, therefore, is to provide a pad cover which enables two pads of the above-mentioned type to be easily inserted in or taken out therefrom, and which, when the two pads are tightly contained therein, enables the two pads to become a unitary structure just like a single large pad on which it is comfortable to sleep.

Other and further objects, features and advantages of the invention will appear more fully from the following description.

DESCRIPTION OF THE PREFERRED EMBODIMENT

Figure 1:
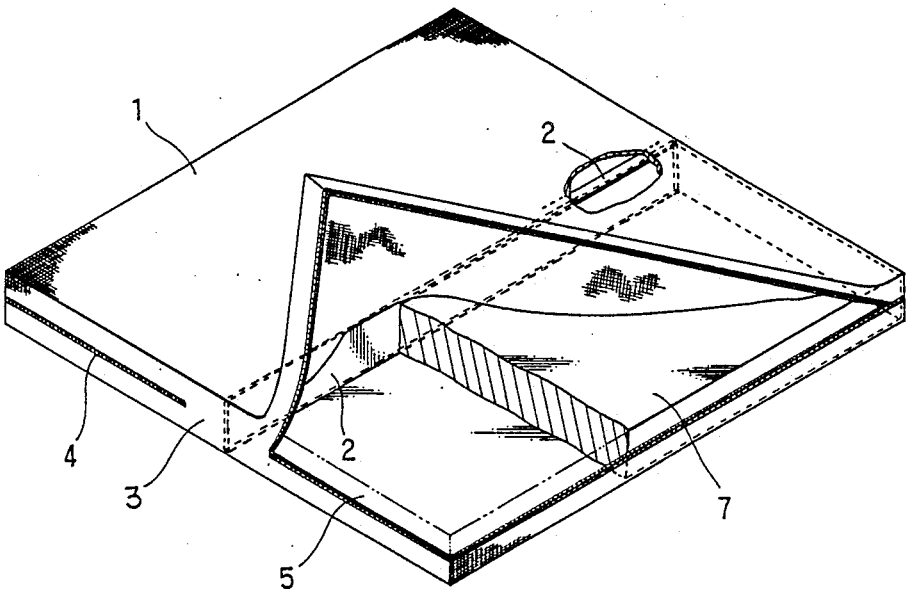
FIG. 1 is a perspective view of an embodiment of the present invention.
Figure 2:
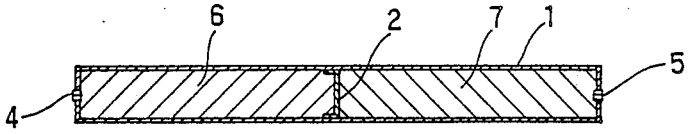
FIG. 2 is a vertical section view thereof.

A preferred embodiment of the invention will now be described in conjunction with the drawings wherein reference numeral 1 denotes a pad cover according to the present invention which has a size capable of containing two pads 6 and 7 tightly. In the pad cover 1 is arranged a partitioning wall 2 for dividing the interior into two. The partitioning wall 2 is usually made of a cloth, at least the upper side and the lower side thereof being sewn to the inner surface of the pad cover 1. The partitioning wall 2 may be a plastic plate. A front short wall 3 is formed on a side surface of the pad cover 1 to which one end of the partitioning wall 2 is secured. A rear short wall opposite front short wall 3 is formed on another side surface of the pad cover 1 to which the other end of the partitioning wall 2 is secured. Openings 4 and 5 are formed starting from both sides of the short walls 3 running through the ends of the two sides. An ordinary mat can be folded small and the opening can also be small. However, the pads 6 and 7 cannot be folded small, and a large opening is needed. The openings 4 and 5 are provided with sealing means such as fasteners, loop and hook fasteners, or the like.

When one pad 6 is inserted in one opening 4 of the pad cover 1, the front corner of the pad 6 come into sliding contact with the partitioning wall 2. When it is further pushed, the front corner advances to the inner side along the partitioning wall 2 and reliably arrives at the end of the partitioning wall 2. That is, the pad 6 is contained in one half portion of the pad cover 1 simply and reliably. When the pad 7 is inserted in the other opening 5, furthermore, the front corner portion proceeds along the opposite side of the partitioning wall 2; i.e., the pad 7 is contained in the other half portion of the pad cover 1 simply and reliably. Using the pad cover 1 of the present invention as described above, two pads can be contained quite in the same manner as when a pad of a single size is contained in the pad cover of the single size. Furthermore, the pads can be taken out separately from the openings 4 and 5 without involving such difficulty as when the pad of the inner side is pulled out from the inner side of the pad cover.

According to the pad cover of the present invention as described above, presence of the partitioning wall makes it easy to pull out or insert the two pads. Further, the two pads do not move during the time in which a person is asleep. That is, the two pads are combined as a unitary structure and a person feels just as comfortable to sleep as when he sleeps on a single large pad. Moreover, since the whole pads are enclosed in a piece of clothing fabric, the pads offer a wide appearance which is just the same as that of the pad of a king size.

What is claimed is:

1. A flexible pad cover of a size capable of containing two pads in parallel, wherein a partitioning wall having ends is provided in said cover dividing said cover into sections, said cover having continuous to and bottom walls, opposite short end walls, and front and rear short side walls to which said ends of said partitioning wall are fastened to said front and rear short walls, said partitioning wall also being fastened to said top and bottom walls, and a closable opening formed in each of said sections, said opening running from said front short side wall to said rear short side wall and along and within said short end walls, said partitioning wall constituting means for providing sliding contact for a corner of a pad being inserted or removed through either of said openings.

2. A pad cover as described in claim 1 wherein said partitioning wall is formed of plastic.

3. A flexible pad cover containing two individual removable unitary pads in parallel, wherein a partitioning wall having ends is provided in said cover dividing said cover into two sections, each of said two sections holding one of said removable pads, said cover having continuous top and bottom walls, opposite short end walls, and front and rear side walls to which said ends of said partitioning wall are fastened to said front and rear short walls, said partitioning wall also being fastened to said top and bottom walls, and a closable opening formed in each of said sections, said opening running from said front short side wall to said rear short side wall and along and within said short end walls, said partitioning wall constituting means for providing sliding contact for a corner of either of said pads being removed or reinserted into either of said openings.

* * * * *